United States Patent [19]

McDonald et al.

[11] 4,247,897

[45] Jan. 27, 1981

[54] TRAIN VEHICLE CONTROL MICROPROCESSOR POWER RESET

[75] Inventors: Michael P. McDonald, Pittsburgh; Larry W. Anderson, West Mifflin, both of Pa.

[73] Assignee: Westinghouse Electric Corp., Pittsburgh, Pa.

[21] Appl. No.: 88,246

[22] Filed: Oct. 25, 1979

Related U.S. Application Data

[63] Continuation of Ser. No. 920,316, Jun. 28, 1978, abandoned.

[51] Int. Cl.[3] ..... B61L 27/00

[52] U.S. Cl. ..... 364/436; 364/424; 364/551; 246/5

[58] Field of Search ..... 364/436, 424, 200, 300, 364/551; 246/5

[56] References Cited

U.S. PATENT DOCUMENTS

| | | | |
|---|---|---|---|
| 3,836,768 | 9/1974 | Clarke et al. | 364/436 X |
| 3,842,334 | 10/1974 | Franz, Jr. | 321/2 |
| 3,976,272 | 8/1976 | Murray et al. | 364/436 X |
| 4,015,804 | 4/1977 | Dobler et al. | 364/436 X |
| 4,093,161 | 6/1978 | Auer, Jr. | 246/5 |

*Primary Examiner*—Edward J. Wise
*Attorney, Agent, or Firm*—R. G. Brodahl

[57] ABSTRACT

There is disclosed a passenger vehicle operation control apparatus and method including program microprocessor control apparatus for providing a dynamic output signal when the microprocessor completes a predetermined main computer control program subroutine and this dynamic output signal operates with a hardware logic circuit apparatus including a timing circuit such that a repetition rate in excess of that required to keep the timing circuit reset is required, otherwise the computer control program is reinitialized.

8 Claims, 5 Drawing Figures

TRAIN VEHICLE CONTROL MICROPROCESSOR POWER RESET

This is a continuation of application Ser. No. 920,316, filed June 28, 1978, now abandoned.

CROSS-REFERENCE TO RELATED APPLICATIONS

The present application is related to the following concurrently filed patent applications which are assigned to the same assignee as the present application; and the respective disclosures of which are incorporated herein by reference:

1. Ser. No. 920,319, which was filed on June 28, 1978 by L. W. Anderson and A. P. Sahasrabudhe and entitled "Speed Maintaining Control of Passenger Vehicles";
2. Ser. No. 920,318, which was filed on June 28, 1978 by D. L. Rush and entitled "Program Stop Control of Train Vehicles";
3. Ser. No. 920,317 which was filed on June 28, 1978 by D. L. Rush, L. W. Anderson and M. P. McDonald and entitled "Speed Decoding and Speed Error Determining Control Apparatus And Method";
4. Ser. No. 920,043, which was filed on June 28, 1978 by M. P. McDonald, T. D. Clark and R. H. Perry and entitled "Train Vehicle Control Multiplex Train Line";
5. Ser. No. 920,104, which was filed on June 28, 1978 by D. L. Rush and J. K. Kapadia and entitled "Door Control For Train Vehicles"; and
6. Ser. No. 920,315, which was filed on June 28, 1978 by D. L. Rush and A. P. Sahasrabudhe and entitled "Desired Velocity Control For Passenger Vehicles".

BACKGROUND OF THE INVENTION

The present invention relates to the automatic control of passenger vehicles, such as mass transit vehicles or the like, and including speed control and speed maintenance while moving along a track, precise stopping of the vehicles in relation to passenger loading and unloading stations and the operation of the vehicle doors.

In an article entitled the BARTD Train Control System published in Railway Signaling and Communications for December 1967 at pages 18 to 23, the train control system for the San Franciso Bay Area Rapid Transit District is described. Other articles relating to the same train control system were published in the IEEE Transactions On Communication Technology for June 1968 at pages 369 to 374, in Railway Signaling and Communications for July 1969 at pages 27 to 38, in the Westinghouse Engineer for March 1970 at pages 51 to 54, in the Westinghouse Engineer for July 1972 at pages 98 to 103, and in the Westinghouse Engineer for September 1972 at pages 145 to 151. A general description of the train control system to be provided for the East-West line of the Sao Paulo Brazil Metro is provided in an article published in IAS 1977 Annual of the IEEE Industry Applications Society at pages 1105 to 1109.

It is known in the prior art to provide a periodic signal responsive apparatus for controlling the energization of an oscillator as described in U.S. Pat. No. 3,842,334 of J. H. Franz, Jr.

A general description of the microprocessors and the related peripheral devices is provided in the Intel 8080 Microcomputer Systems Users Manual currently available from Intel Corp., Santa Clara, California 95051.

SUMMARY OF THE INVENTION

An improved passenger vehicle operation control apparatus and method are provided for controlling the vehicle in relation to provided vehicle control programs with at least one microprocessor operating with those control programs. Each microprocessor includes a main computer control program that includes the provision of a dynamic output toggle signal each time the main computer control program is properly executed, and is operative with a discrete hardware logic circuit responsive to the occurrence of that output toggle signal at a repetition rate in excess of a predetermined reset rate and if said repetition rate falls below that predetermined reset rate due to a power supply failure or signal noise interference or the like disturbance, the main control program is reinitialized and the computer is reset as though a power supply failure has occurred.

DESCRIPTION OF A PREFERRED EMBODIMENT

Figure 1:
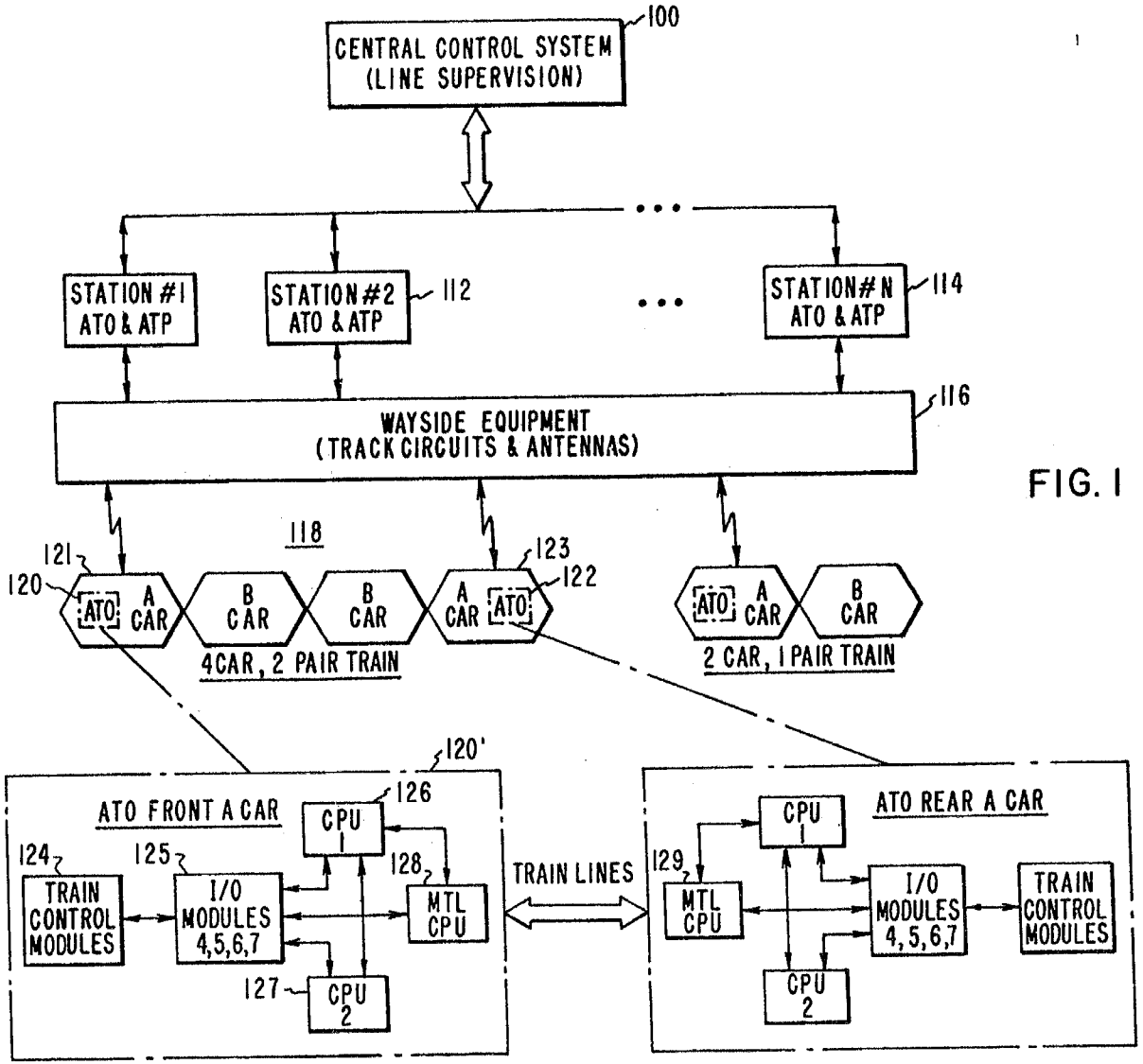
FIG. 1 is a schematic showing of the passenger vehicle system operative with the present control apparatus.

As shown in FIG. 1, the central control system 100, which is usually located in a headquarters building or the like, receives information about the transit system and individual vehicle train operation to apply desired performance adjustments to the individual vehicle trains. The central control supervises the schedules, spacing and routing of the train vehicles. The passenger loading and unloading stations 112, 114 and so forth are provided to operate with the central control 100 as desired for any particular transit system. The wayside equipment 116, including track circuits and antennae, is located along the vehicle track between the stations and is provided to convey information in relation to the passenger vehicles passing along the track. A train 118 is shown including four vehicle cars in the arrangement of an A type car at each end of the train with intermediate B type cars. The train control apparatus 120 carried by the front A type car 121 of the train 118 is shown in greater detail in the phantom showing 120' of the front car 121. The train control modules 124 in the train control apparatus 120' include the program stop receiver module, the speed code receiver module, the vital interlock board, power supplies and all the modules required to interface with the other equipment carried by the train vehicle 121. Information is sent in relation to the input/output modules 125 and the microprocessor computers 126, 127 and 128. There is a direct communication link through the input/output modules 125 between the CPU1 computer 126 and the CPU2 computer 127. There is a direct communication link from the CPU1 computer 126 to the multiplex train line MTL CPU computer 128. A similar train control apparatus 122 is provided for the rear car 123. The front car 121 and the rear car 123 are connected together through well-known train lines, which go through the couplers and the individual train vehicles. The multiplex train line connected between the front multiplex CPU 128 and the rear multiplex CPU 129 is one pair of lines in the train line.

Figure 2:
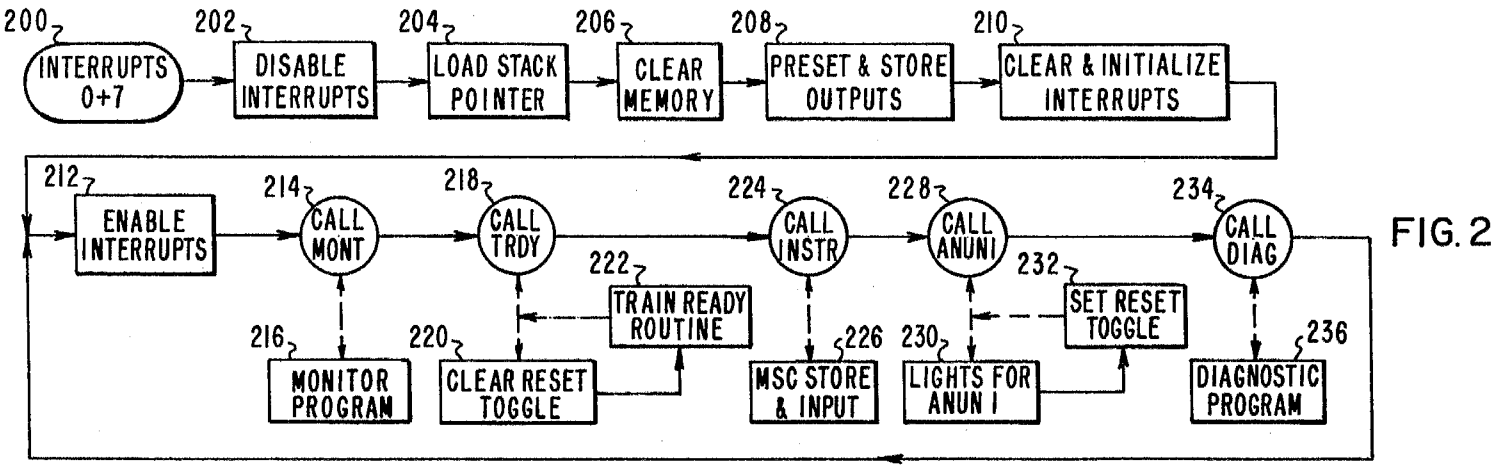
FIG. 2 illustrates the flow chart for the microprocessor CPU1 main control program provided for operation with the vehicle control programs as interrupts.

In FIG. 2, there is shown the flow charts for the microprocessor computer CPU1. This main control program for the computer CPU1 calls the vehicle control program subroutines and then comes back and repeats itself by operating in a circle. The vehicle control programs as described in the above cross-referenced patent applications work on an interrupt basis and are totally independent from this main computer control program. The CPU1 main control program shown in FIG. 2 is entered in two places. At block 200 one of a zero interrupt or a seven interrupt will enter the program as though a power OFF followed by a power ON situation had occurred. Anytime the CPU1 power comes on, the computer operation starts in location 0 and goes through this main control program to initialize the system and start the control system running. Block 200 can be entered in two cases. One is when the power comes on and the other one is from restart 7 instruction, which is executed in the computer when the program gets lost for some reason and a fault occurs, to reinitialize the program and start over. At block 202 any previous interrupts are disabled since the computer wants to know the present state of the vehicle control system operation. At block 204 the stack pointer is set up; this is a hardware register which keeps track of the interrupt and jump locations, and at block 204 sets it to an initial location to know exactly where the counter is. At block 206 selected RAM memory locations are cleared. At block 208 after the computer control system has been down, it is desired to set an initial and known pattern of operation, so block 208 presets initial conditions that should get out to the train vehicle control operation as fast as possible; for example, the vehicle reference velocity is set to zero, and for every output port shown in FIGS. 4 and 5 of above-referenced application Ser. No. 920,318, a predetermined bit pattern which is the determined best case is provided by sequentially going through the storage tables and providing this known output to every output port. Block 210 clears out and initializes the interrupt system and gets it ready to go. Thusly, blocks 200 through 210 initialize the vehicle control system. Block 212 enables the interrupts; so the next interrupt received, such as a speed code interrupt, will be serviced. The main computer control program, which is just a series of calls, has been started. Block 214 calls MONT, which is the monitor program; and it is shown on the side at block 216 to monitor the switches on the front panel. A location can be set up in memory to monitor or look at this program and display the contents of that location. As soon as the monitor program 216 is finished, a return is made to the main program. Block 218 calls TRDY, which routine at block 220 does two things. First, it clears the reset toggle bit by setting it to 0 and sending it out; and the next part 222 of the same routine does the train ready function which indicates the vehicle control system is ready for a new train destination from the wayside. The corresponding memory location is zero and the ID system can now put a new number in that location. It should be noted that the ID system that has actually operated for over two years in Sao Paulo, Brazil will provide the desired new destination code information for this purpose. Block 220 is specifically oriented towards this main computer control program by clearing the bit and sending out the zero; and block 222 is doing the train ready function. Block 224 calls INSTR, which is a miscellaneous input and store routine to go out and bring in some bits and store them in known locations. Block 224 provides a call and block 226 provides the action. Block 228 calls ANUN1, or the annunciator routine, which lights the lights on the annunciator panel 1 in block 230 and at block 232 sets and outputs the reset toggle bit and then it returns to block 228. Block 234 calls the diagnostic program; and block 236 comprises the individual diagnostic programs that may be provided. There are several well known prior art programs that could be used for diagnostic purpose here to diagnose the operating state of the train vehicle and the vehicle control system. For example, the diagnostic programs can check the antennas, check ramps and check selected power levels. The antenna check is in relation to each antenna hanging at the ends of the train vehicle where a wire is placed around each antenna and a voltage is supplied to that wire with a check made to establish that the circuit is continuous and the antenna has not fallen off the vehicle.

For the voltages that are considered to be reasonably critical, each voltage is measured and brought in on an analog input and checked against a desired limit; and if this check fails, then an alarm is given. After blocks 234 and 236, the program loops around to block 212 and repeatedly operates as here described in a loop manner. The time spacing between the clear and setting of the reset toggle output signal is selected as shown in FIG. 2 to first reset it as close to the front of the main control program as reasonable, and then try to set it as close to the end of the program as reasonable to get enough time in-between such that the hardware reset logic device can pick up the dynamic setting and resetting of this toggle output signal.

Figure 3:
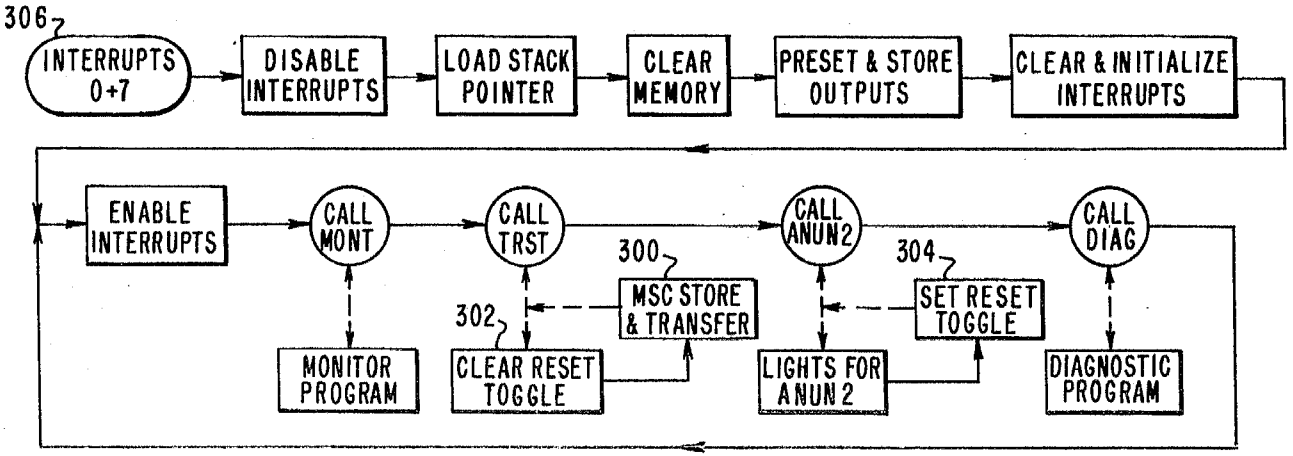
FIG. 3 illustrates the flow chart for the microprocessor CPU2 main computer control program for operation with the vehicle control programs as interrupts.

The CPU main control program shown in FIG. 3 is generally similar to the main control program shown in FIG. 2, with the exception that it does not have the train ready routine 222 shown in FIG. 2 and the name of the MCS store and input routine 226 shown in FIG. 2 is changed to MCS store and transfer at block 300 of FIG. 3. Again, as early as reasonable, the reset toggle bit is cleared at block 302, and as late as reasonable, the reset toggle bit is set at block 304. The diagnostics are done after that because at the time of writing the main control programs shown in FIGS. 2 and 3 it was not known if the diagnostic program would be zero or extensive in terms of operation.

Figure 4:
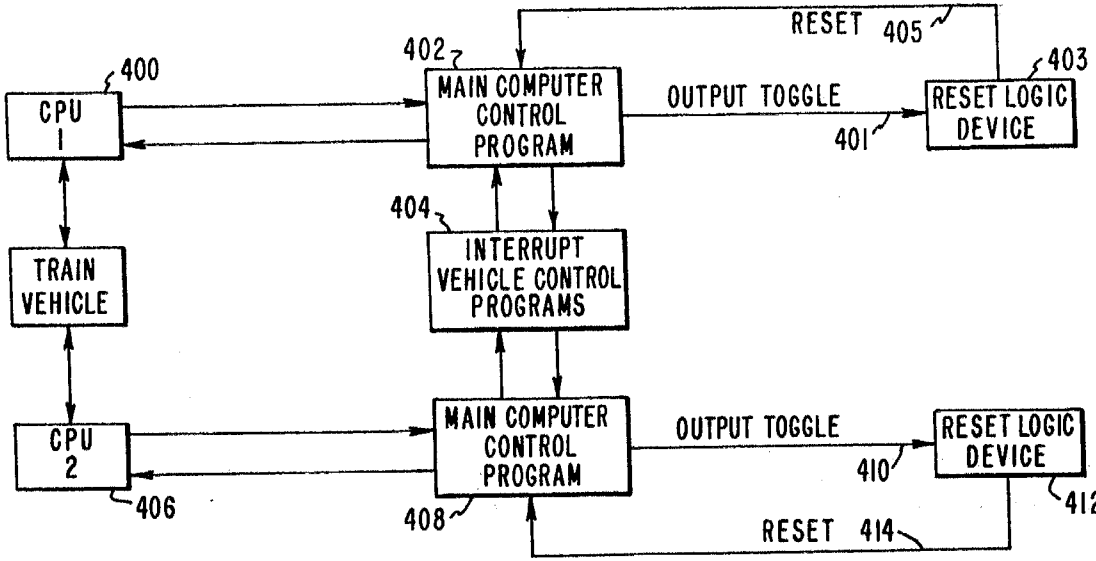
FIG. 4 illustrates the here-described main computer control program reset operation for each of two control computers operative with a passenger vehicle.

As shown in FIG. 4, the CPU1 computer 400 is going through the main control program 402, which is shown in FIG. 2, when the computer 400 is not doing any of the specific interrupt routine vehicle control programs 404. Each of these interrupt vehicle control programs 404 is described in greater detail in one of the above cross-referenced related patent applications. The computers CPU1 400 and CPU2 406 are physically on each A-type car; but they are used for a single set of ATO equipment for an AB pair of vehicle cars. Either end of the AB pair can be a head end; and either end can be a tail end. If no interrupts are received at block 212 of FIG. 2, the CPU1 main control program shown in FIG. 2 can be running substantially faster than 18 times a second. Only the computers CPU1 and CPU2 for the designated head end vehicle of a train of vehicles operate to control the train. For example, a train of six car vehicles has three sets of AB pairs, the middle pair and the rear pair are constantly looking for designation as a head end; and if they are never set as the head end of the train, they do not control the train but continue looking to be designated as a head end pair. Similarly, the computer CPU2 406 goes through the main computer control program 408, which is shown in FIG. 3, when the computer 406 is not doing any of the specific interrupt vehicle control program routines 404. When the computer 400 is operating properly and without a fault hang-up in regard to the main computer control program 402 or any one of the interrupt vehicle control programs 404, then the output toggle signal 401 continues to be set and reset as a dynamic output signal applied to the reset logic device 403. As long as the output toggle signal remains dynamic, the reset logic device 403 will not provide the reset signal 405 to the block 200 of the main computer control program 402, shown in FIG. 2. When the computer 406 is operating properly and without a fault hang-up in regard to the main computer control program 408 or any one of the interrupt vehicle control programs 404, then the output toggle signal 410 continues to be set and reset as a dynamic output signal applied to the reset logic device 412; and as long as the output toggle signal 410 remains dynamic, the reset logic device 412 will not provide the reset signal 414 to the block 306 of the main computer control program 408 shown in FIG. 3.

Figure 5:
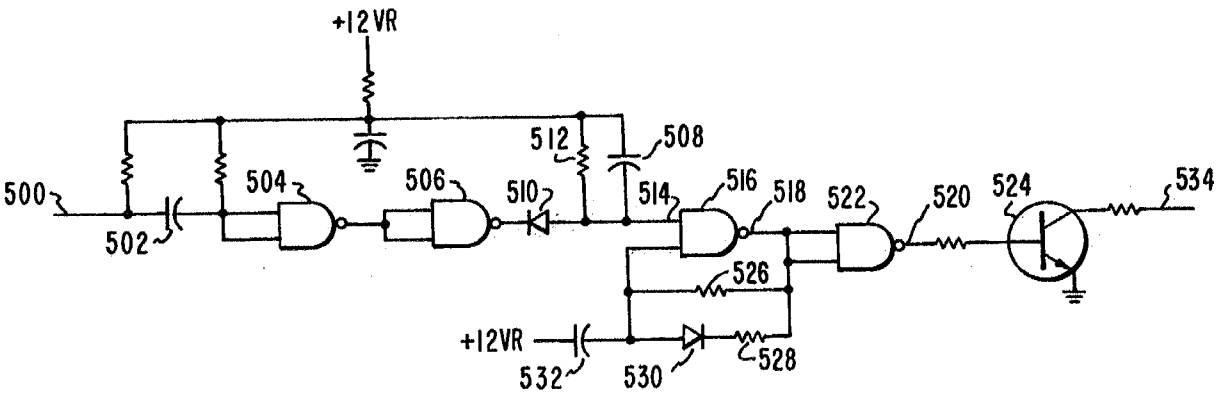
FIG. 5 shows the hardware logic circuit provided to respond to the microprocessor output toggle signal of each microprocessor CPU1 and CPU2.

In relation to FIG. 5, each of the reset logic devices 403 and 412 shown in FIG. 4 is in accordance with the circuit apparatus shown in FIG. 5. The output toggle signal which is the bit that gets set and reset in the normal operation of the main computer control program is applied to input 500. The signal gets differentiated by capacitor 502 and is buffered by gate AND 504 and then by gate AND 506. These gates are really just used as buffers. Every time the signal an input 500 has a negative going edge, it will recharge and pull the bottom end of capacitor 508 to ground through diode 510. When the signal at input 500 goes high, the diode 510 prevents the gate AND 506 from trying to pull the bottom end of capacitor 508 towards a positive value. Capacitor 508 has a discharge path through resistor 512, having a very high impedance of 2.4 megohms, such that a fast charge and slow discharge time characteristic is provided for capacitor 508. When the signal at input 500 is dynamic, then input 514 of AND 516 will be low. As long as input 514 stays low, then output 518 stays high and output 520 of AND 522 stays low, such that transistor 524 stays off. If this high signal edge stops occurring on input 500, then eventually capacitor 508 will discharge and input 514 of AND 516 will go high. When that happens, then AND 516 with resistors 526 and 528, diode 530 and capacitor 532 comprises a free-running stable multivibrator which will generate a short pulse at a rate of approximately once every twenty seconds. If output 518 of AND 516 is high and then goes low for a short period of time and then goes back high again, the multivibrator will wait twenty seconds and generate that same short pulse again with output 520 of AND 522 being the inverse of that so that a positive going pulse is provided once every approximately twenty seconds, which turns the transistor 524 on for a short period of time once every twenty seconds. The collector of transistor 524 is connected to the reset signal output 534. For as long as the computer CPU runs normally, then the input 500 will be dynamic, and the output 534 will not output the reset pulse; and the presence of a reset signal on output 534 determines initializing the main computer control program.

We claim:

1. In apparatus for determining the desired performance of a vehicle, the combination of means for providing a first operation periodically executing a sequence of steps in relation to said desired performance of the vehicle and developing an output signal for each periodic completion of the sequence of steps and for providing a second operation effecting a predetermined reinitialization of said first operation, means responsive to the respective output signals being developed at an actual repetition rate in accordance with each periodic completion of the sequence of steps for selecting one of the first operation and the second operation by a comparison of said actual repetition rate with a predetermined reference repetition rate, and means responsive to each periodic execution of the sequence of steps for providing said desired performance of the vehicle.

2. The apparatus of claim 1, with said apparatus being operative with a power supply and with said reference repetition rate being predetermined such that a power supply failure will result in the actual repetition rate being less than the reference repetition rate.

3. The apparatus of claim 1, with said selection means being operative to select the second operation when the actual repetition rate is less than the reference repetition rate.

4. The apparatus of claim 1, with said selection means being operative to select the first operation while the actual repetition rate remains greater than the reference repetition rate.

5. The apparatus of claim 1, with said first and second operation providing means including at least one digital computer device operative with a control program defining said sequence of steps, said digital computer device developing said output signal for each first operation periodic execution of that control program, and with said selection means including a hardware logic circuit responsive to the occurrence of said output signal at a repetition rate in excess of the reference repetition rate for selecting the first operation periodic execution of that control program.

6. The apparatus of claim 1, with one step in said sequence of steps being to develop said output signal during each periodic execution of that sequence of steps.

7. The method of controlling a vehicle, including the steps of providing a sequence of control operations for said vehicle during each of successive time periods, providing an output signal in relation to the completion of said sequence of control operations during each of said successive time periods, sensing the actual repetition rate of the provided output signals for comparison with an established reference repetition rate, providing an initialization of said sequence of control operations in accordance with a predetermined relationship between the actual repetition rate and the reference repetition rate, and controlling the vehicle in response to said sequence of control operations.

8. The method of claim 7, with said predetermined relationship being that the actual repetition rate is less than the reference repetition rate.

* * * * *